US010786697B2

(12) United States Patent
Liu

(10) Patent No.: US 10,786,697 B2
(45) Date of Patent: Sep. 29, 2020

(54) CONNECTION STRUCTURE FOR TRAMPOLINE FRAMES

(71) Applicant: Qingdao Jinhuaxing Sports Products Co., Ltd, Qingdao (CN)

(72) Inventor: Yunwei Liu, Qingdao (SD)

(73) Assignee: Qingdao Jinhuaxing Sports Products Co., Ltd, Qingdao, Shandong Province (CN)

( * ) Notice: Subject to any disclaimer, the term of this patent is extended or adjusted under 35 U.S.C. 154(b) by 65 days.

(21) Appl. No.: 15/984,333

(22) Filed: May 19, 2018

(65) Prior Publication Data

US 2019/0105523 A1 Apr. 11, 2019

(30) Foreign Application Priority Data

Oct. 7, 2017 (CN) ..... 2017 1 0926507

(51) Int. Cl.
*A63B 5/11* (2006.01)
*A63B 71/02* (2006.01)

(52) U.S. Cl.
CPC ..... *A63B 5/11* (2013.01); *A63B 71/023* (2013.01); *A63B 2210/50* (2013.01)

(58) Field of Classification Search
CPC ..... A63B 5/11; A63B 71/023; A63B 2210/50
See application file for complete search history.

(56) References Cited

U.S. PATENT DOCUMENTS 2,819,755 A * 1/1958 Berger ..... A61H 3/008 482/69
2,990,203 A * 6/1961 Grover ..... E04G 7/02 403/174
3,472,539 A * 10/1969 Fenwick ..... F16B 7/0446 403/171
3,502,357 A * 3/1970 Wagner ..... E04F 11/1817 403/205
4,339,123 A * 7/1982 Rich ..... A63B 5/11 403/205
5,015,116 A * 5/1991 Nardone ..... B64G 9/00 403/174
5,435,110 A * 7/1995 Stol ..... B62D 23/005 403/170
6,974,276 B2 * 12/2005 Kirchner ..... A47B 57/54 403/385
7,220,218 B1 * 5/2007 Chu ..... A63B 5/11 403/170
7,927,254 B2 * 4/2011 Adams ..... A63B 5/11 482/27

(Continued)

*Primary Examiner* — Andrew S Lo
(74) *Attorney, Agent, or Firm* — QPatents

(57) ABSTRACT

A trampoline frame includes a number of frame components arranged to form a circle or other shape around a flexible fabric trampoline bed. The frame components are fastened together by inserting them into tee joints. The tee joints have guard poles extending above the level of the trampoline bed to support a safety net or rail. Leg components extend beneath the tee joints to support the trampoline frame structure. Each tee joint is concentrically fitted together with adjacent frame components. The guard poles extend through the tee joint to be concentrically fitted together with the leg components. Bolts extend through the assembled tee joints and other components to further strengthen the trampoline structure.

17 Claims, 5 Drawing Sheets

(56) References Cited

U.S. PATENT DOCUMENTS 8,574,132 B2 * 11/2013 VanElverdinghe ..... A63B 5/11 482/27
9,717,940 B1 * 8/2017 Schueler ..... A63B 5/11
10,166,422 B2 * 1/2019 Hsiang ..... A63B 5/11
10,232,208 B2 * 3/2019 Chen ..... A63B 5/11
2004/0091307 A1 * 5/2004 James ..... F16B 7/04 403/188
2004/0176214 A1 * 9/2004 Yueh ..... A63B 5/11 482/27
2006/0189441 A1 * 8/2006 VanElverdinghe ..... A63B 5/11 482/27
2007/0049463 A1 * 3/2007 Chu ..... A63B 5/11 482/27
2010/0075810 A1 * 3/2010 Schaffer ..... A63B 5/11 482/27
2010/0240496 A1 * 9/2010 Chen ..... A63B 5/11 482/27
2012/0054999 A1 * 3/2012 Hsiang ..... A63B 5/11 29/428
2012/0289379 A1 * 11/2012 Stokes ..... A63B 5/11 482/27
2013/0045837 A1 * 2/2013 Hsiang ..... A63B 5/11 482/27
2014/0066259 A1 * 3/2014 Andon ..... A63B 5/11 482/27
2015/0051049 A1 * 2/2015 Andon ..... A63B 5/11 482/29
2017/0108152 A1 * 4/2017 Hsiang ..... F16L 41/021
2017/0120094 A1 * 5/2017 Andon ..... A63B 5/11
2017/0239504 A1 * 8/2017 Chen ..... A63B 5/11
2017/0312563 A1 * 11/2017 Chen ..... A63B 5/11
2017/0361143 A1 * 12/2017 Mehr ..... A63B 5/11
2018/0093120 A1 * 4/2018 Chen ..... A63B 5/11
2018/0296869 A1 * 10/2018 Chen ..... A63B 5/11
2018/0369629 A1 * 12/2018 Publicover ..... A63B 5/11

* cited by examiner

100

200

300

350

351

500

CONNECTION STRUCTURE FOR TRAMPOLINE FRAMES

CROSS-REFERENCE TO RELATED APPLICATIONS

The present application claims priority from, and incorporates by reference in its entirety, Chinese patent application no. 201710926507.3 filed on Oct. 10, 2017.

BACKGROUND

Technical Field

Various embodiments of the present invention relate to sports equipment, and more specifically, to connection structures for trampoline frames.

Description of Related Art

It is important that sports equipment be designed to avoid structural failure that could lead to injury. This is especially true of load bearing sports and exercise equipment that comes in close contact with the human user. Weight lifting machines and free weight equipment are two prime examples of the type of equipment that must be designed for structural integrity. Such equipment is often subject to repeated forces, twisting motions and stresses likely to cause structural failure.

BRIEF SUMMARY

Recognizing the importance of avoiding sports equipment structural failures that could lead to user injuries, the present inventor developed improved structural components to strengthen trampoline frame structures. The various embodiments disclosed herein achieve these goals, and others, which will become readily apparent in view of the drawings and detailed disclosure.

Various embodiments disclosed herein are drawn to trampoline frames configured to hold a flexible fabric trampoline bed attached to the frame with a number of torsion springs. The frame has a number of tee joints at the intersection between frame components. The frame components may be curved so that a number of them can be assembled into a circular structure to hold the trampoline bed. The frame components each have slotted holes spaced apart to receive one end of the torsion springs. The other end of each torsion spring is attached to the trampoline bed.

In various embodiments the tee joints each have a frame passageway (hole) extending through it lengthwise. The frame passageway is sized to accept an end of one frame component into one side and another frame component into the other side. In various embodiments the end of one frame component slides into the other, adjacent frame component within the frame passageway. The frame components and the tee joints have through-holes in them sized to accept a guard pole. The guard poles extend upward above the level of the trampoline bed to support a guard net or guard rail. In various embodiments the through-holes of adjacent frame components align with the through-hole of their tee joint so that a guard pole (or other component) may be inserted into the through-holes. Inserting the guard pole down into the tee joint via the through-holes aids in strengthening the connection joint where the various parts intersect.

In various embodiments each tee joint has a leg holder section configured to receive a leg component that extends beneath the level of the trampoline bed in order to support the trampoline frame. The leg components may either sit directly on the ground, or attach to bottom pipe components that sit on the ground. Some embodiments do not have a guard pole extending from each of the tee joints. Such embodiments may be configured with an internal blocker at each tee joint without a guard pole. The internal blockers extending down into the tee joints via the through-holes to add strength to the connection joint. Some embodiments may additionally have bolts that pass through the various parts to further strengthen the trampoline frame.

BRIEF DESCRIPTION OF THE DRAWINGS

The accompanying drawings, which are incorporated in and constitute part of the specification, illustrate various embodiments of the invention. Together with the general description, the drawings serve to explain the principles of the invention. In the drawings.

DETAILED DESCRIPTION

Load bearing sports and exercise equipment such as weight lifting equipment must be designed to avoid structural failure that could lead to injury of the user. The present inventor recognized that trampoline frames are also subjected to the type of repeated compression forces and twisting motions that can cause structural failures. Since the forces and structural stress exerted on trampoline frames are dampened by springs, the forces and stresses may not be as apparent as the forces of steel weights slamming together on weight lifting equipment. Nonetheless, trampoline frames are subject to compression forces and twisting forces each time a user jumps up and down on the trampoline. Over time the joints of the trampoline frame may incur many hundreds of thousands of compression and twisting stress forces. The inventor developed the embodiments herein to ensure the structural integrity of trampolines frames and avoid injury due to equipment failure.

The present inventor recognized the drawbacks of conventional trampoline frame components that are connected to one another by welded tee joint pieces. For example, the welded tee joint pieces are used to connect the crosspieces to the trampoline leg pipes of conventional trampoline frames. The welded seams tend to be the weakest points in the structure, and often endure the greatest stresses and forces. Over time this may result in welding breakage and tearing due to the repetitive compression forces and twisting stress over the life of a conventional trampoline. In addition, the present inventor recognized drawbacks in the way conventional trampoline leg pipes are connected together using fasteners. The conventional trampoline frame fastener is located at the point of connection, and often becomes loose after repeated usage. This results in an unstable frame structure due to this type of conventional trampoline leg pipe fastener. The unstable frame structure of conventional trampolines tends to cause defects such as wear, breakage and bending. The present inventor recognized these and other drawbacks that cause safety hazards, and in response developed an innovative new solution to the aforementioned problems.

Figure 1:
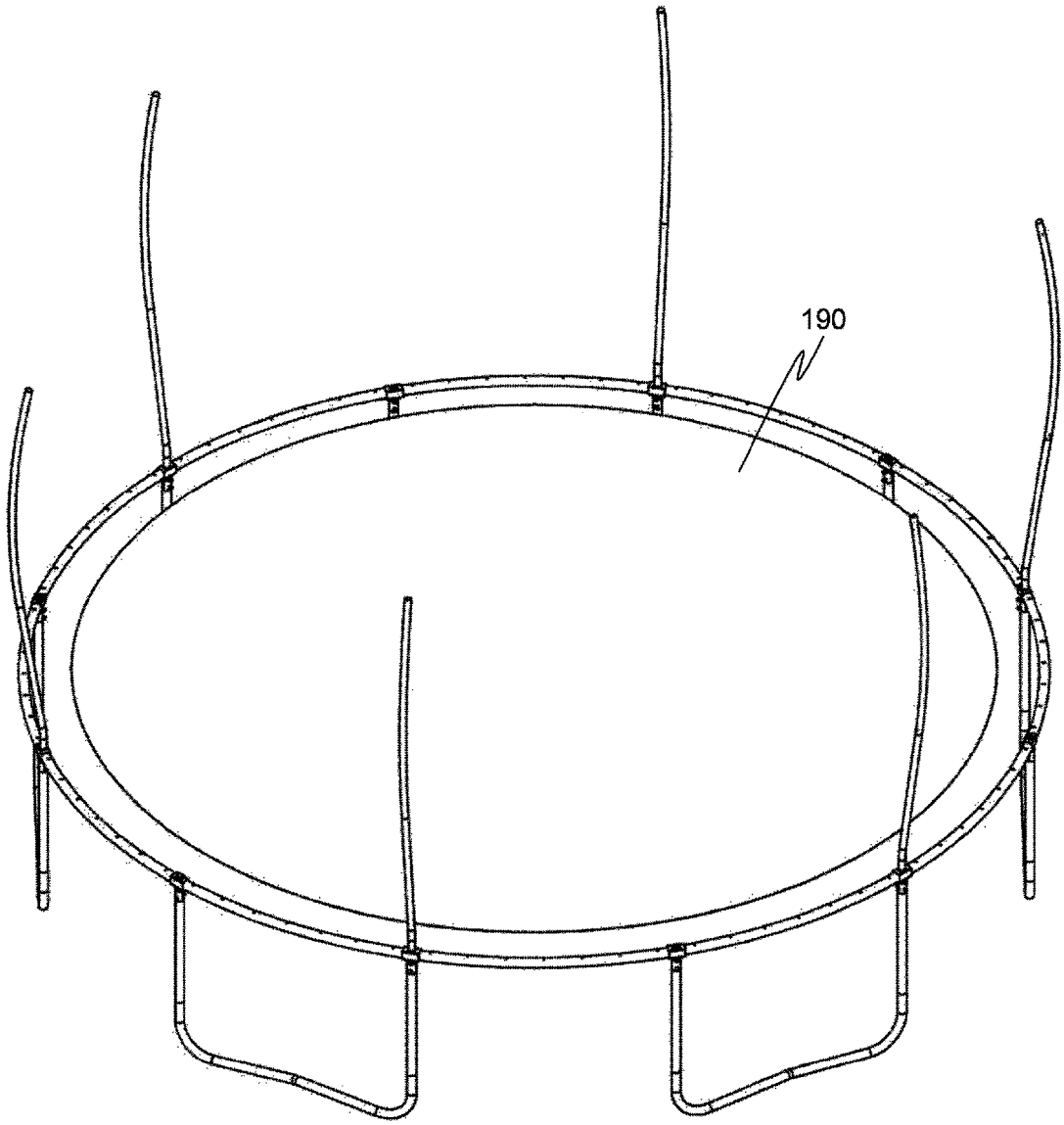
FIG. 1 depicts an oblique view of trampoline frame structure according to various embodiments disclosed herein.
Figure 1:
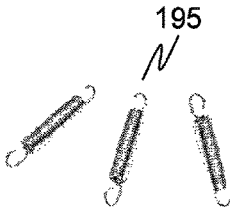

FIG. 1 depicts an oblique view of trampoline frame structure 100 according to various embodiments disclosed herein. The various embodiments provide connection structures for trampoline frames aimed at addressing the drawbacks and technical problems existing in the design of conventional trampoline frames. The trampoline connection structures of the various embodiments disclosed herein include components that may be arranged in multiple configurations, depending upon the requirements of the implementation.

Various trampoline frame components are arranged to support the flexible fabric trampoline bed 190. A number of springs such as tension springs 195 are used to span between the trampoline bed 190 and the trampoline frame. Typically, the tension springs 195 are inserted into holes in the frame components on one end, and inserted into metal grommets sewn into the fabric trampoline bed 190. The tension springs, upon being stretched, exert pulling forces capable of rebounding a user up into the air. FIG. 1 depicts three tension springs 195 for illustrative purposes. But in practice a trampoline has many more than three tension springs 195—e.g., one spring spaced from approximately three inches apart to a foot or more apart. In some implementations, connection of the springs may be doubled up—that is, two (or more) springs may be connected either at the connection points on the frame or the connection points on the trampoline bed 190, or both.

The trampoline frame structure 100 depicted in FIG. 1 is round as viewed from above, and is configured with tension springs that hold a similarly shaped fabric trampoline bed in place. In other embodiments the frame and accompanying trampoline bed may be square, rectangular, oval, arc-shaped, octagonal, or other like shapes known to those of ordinary skill in the art.

Figure 2:
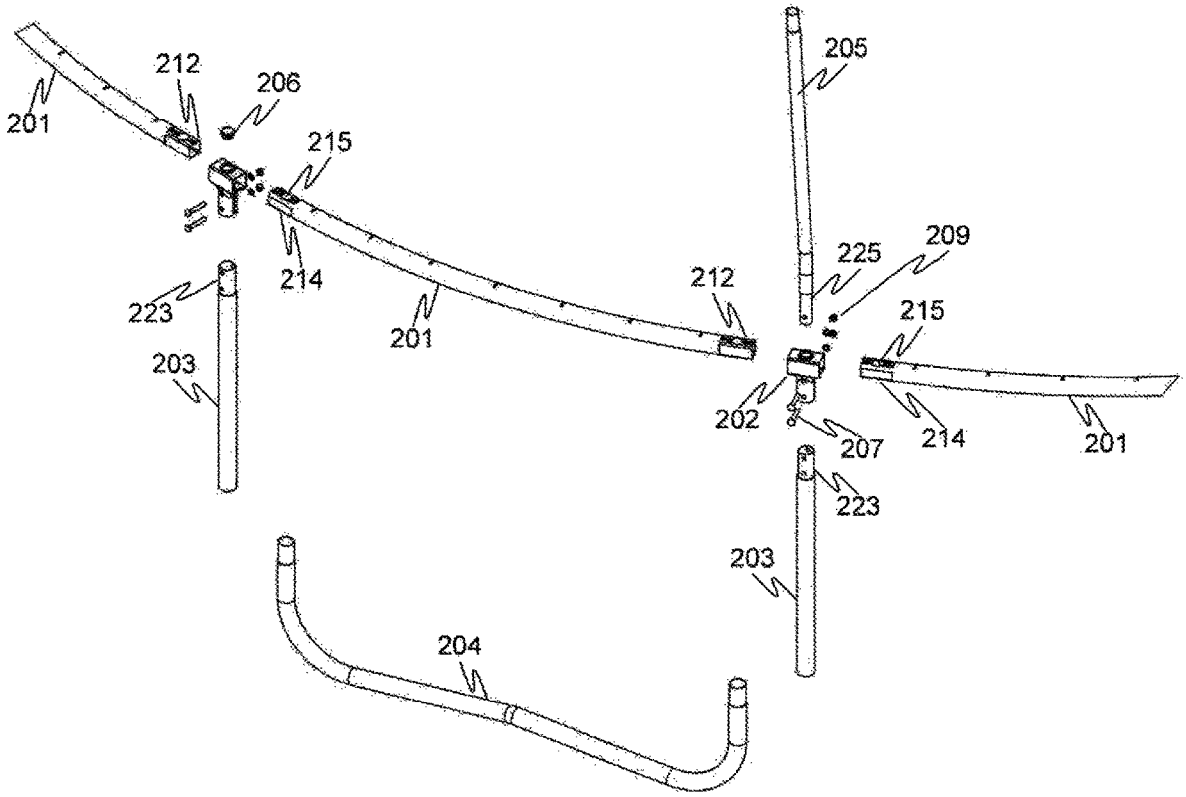
FIG. 2 depicts an exploded view of the several trampoline frame components according to various embodiments disclosed herein.

FIG. 2 depicts an exploded view 200 of the several trampoline frame components according to various embodiments disclosed herein. The depicted trampoline frame structure 200 includes frame components 201, tee joints 202, leg components 203 (sometimes called standing pipe components 203), bottom pipe components 204, guard poles 205, internal blockers 206 and bolts 208.

Each trampoline has a number of curved frame components 201 that fit together to form a circle that encompasses and supports the trampoline bed. Each frame component 201 has a number of tension spring holes or other attachment mechanisms configured to accept tension springs to hold the trampoline bed 190, shown in FIG. 1, in place. A tee joint 202 is positioned between each of the frame components 201 at their connection point to connect them securely together. At least some of the tee joints 202 have a guard pole 205 removably connected to and extending upward from them. In the embodiment depicted in FIG. 1, every other tee joint 202 has a guard pole 205 extending upward from it. In other embodiments every tee joint 202 has a guard pole 205 extending upward from it. In yet other embodiments every third tee joint 202 has a guard pole 205 extending upward from it. The guard poles 205 each have a guard connection end 225 that extends down into, and connects with, a tee joint 202. Some embodiments have one or more internal blockers 206 removably inserted into the tee joints 202. Some embodiments have internal blockers 206 all the way around, connected to each tee joint 202. Other embodiments have an assortment of parts connected to the different tee joints 202. For example, some embodiments have an internal blocker 206 at every other tee joint 202, with guard poles 205 removably attached to the other tee joints 202.

Each of the leg components 203 has a leg connection end 223 that connects to a tee joint 202. The leg components 203 each extend downward beneath the tee joint 202 where the leg component 203 connects to a bottom pipe component 204 that rests on the ground or floor. In FIG. 2 the bottom pipe component 204 is shaped like a low, wide W. That is, the outer portions of bottom pipe component 204 just inside the 45 degree bend rest on the ground while the center portion comes up away from the ground. This aids in allowing the trampoline frame 200 to flex somewhat to accommodate a yard or floor that is not perfectly planar. In other embodiments the bottom pipe component 204 may be flat across its length where it contacts the ground, rather than W shaped. In at least some embodiments the bottom pipe component connects to three or more of the leg components 203, rather than two as shown in FIG. 2. Yet other embodiments have leg components 203 that sit directly on the ground, have detachable feet that sit on the ground, or are inserted into the ground, rather than being tied together with one or more bottom pipe components.

Either one or both ends of various components and parts are constricted to a narrower diameter, e.g., frame components 201, bottom pipe components 204, guard poles 205. The constricted section is typically four inches long, plus or minus 1.5 inches, but may be as long as twelve inches or as short as one-half inch in various implementations. In some embodiments the constricted sections of the various components are all approximately the same length, while in other embodiments the constricted sections of some components may be longer than those of other components. The constricted ends are configured to be inserted into an opening of the adjacent component so as to concentrically fit together. In this way the diameter at the connection point of adjacent components remains relatively consistent. However in some other embodiments the component ends may be left with their diameters intact rather than constricting them. In such embodiments the ends of the adjacent components are flaired out or otherwise enlarged, making the end section of them larger in diameter so as to receive the standard sized ends and join the two components.

In the embodiment 200 depicted in FIG. 2 each of the frame components 201 has a first end 212 and a second end 214. In this embodiment the first end 212 has squared surfaces that fit within the square frame passageway hole of tee joint 202. The second end 214 of the adjacent frame components 201 fits within the first end 212, sliding far enough in so that the through-holes 215 of first end 212 and second end 214 line up to receive the constricted guard connection end 225 of guard pole 205.

Figure 3:
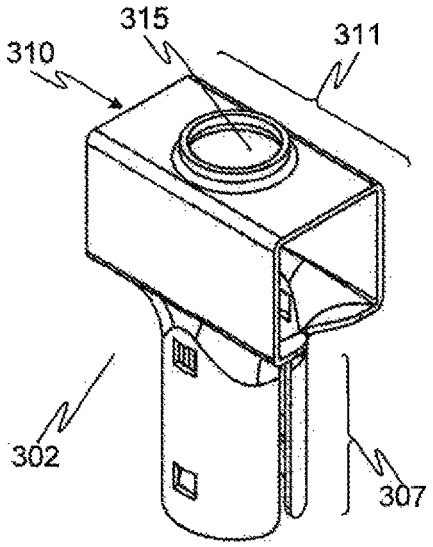
FIG. 3 depicts oblique views of tee joints according to various embodiments disclosed herein.
Figure 3:
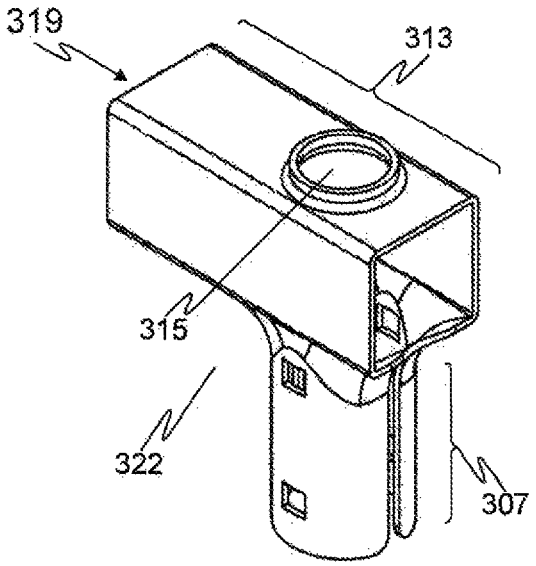
Figure 3:
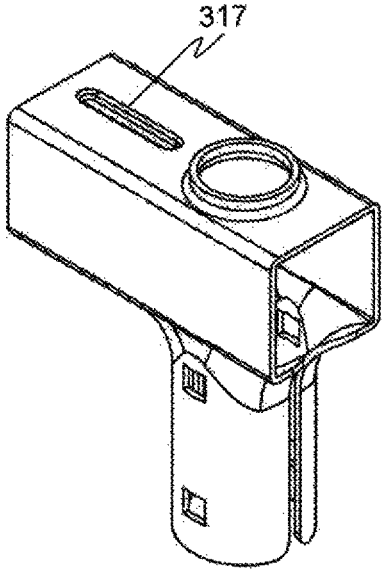

FIG. 3 depicts oblique views 300 and 350 of tee joints 302 and 322, respectively, and oblique view 351 similar to view 350, according to various embodiments disclosed herein. Tee joint 302 is similar to tee joint 202 depicted in FIG. 1. In various embodiments the tee joint 302 may be manufactured using a welding-free sheet metal stamping process. A through-hole 315 is arranged on the upper part of tee joint 302 to facilitate penetration of the guard pole 205 shown in FIG. 2.

Some embodiments may use a tee joint 322 configured with an end that extends further in the lateral direction. That is, one side the tee body 313 of tee joint 322 extends further from leg holder section 307 than the tee body 311 of tee joint 302 extends from its leg holder section 307. As such the length of the frame passageway 319 of tee joint 322 is longer than the frame passageway 310 of tee joint 302. The tee joint 322 also has a through-hole 315. The through-hole 315 may be a raised through-hole as shown in FIG. 3, or may be flush to the surface of tee joints 302 and 322. The guard pole 205 penetrates down via the through-hole 315 into the tee joint 302 or 322. The raised through-hole 315 provides additional structural support for guard pole 205, of FIG. 2, inserted into it. The oblique view 351 depicts a part similar to tee joint 322 but with the addition of a slotted hole 317 to aid in reinforcing a guard pole 205 inserted into raised through-hole 315. A reinforcing member may be configured to span between the slotted hole 317 and the guard pole to provide support.

With reference to the parts shown in FIG. 2, the adjacent frame components 201 each insert into opposite ends of frame passageway 310 of tee joint 302. The first end 212 of one frame component 201 fits into one end of passageway 310 and second end 214 of the adjacent frame component 201 fits into the other end of passageway 310. In this way the two frame component ends connect together within the tee joint 302. For example, the second end 214 may be configured smaller so as to fit within the first end 212. In such embodiments the first end 212 of one frame component 201 slides far enough into frame passageway 310 of tee joint 302 for the through-hole 215 in first end 212 to line up with the through-hole 315 of tee joint 302. The second end 214 of the adjacent frame component 201 slides into the opposite side of the tee joint frame passageway 310 and also slides into the first end 212 which is positioned within frame passageway 310. The second end 214 slides far enough into frame passageway 310 so that the through-holes 215 of the first end 212 and the second end 214 line up with the through-hole 315 of tee joint 302. In at least some embodiments this allows constricted end 223 of leg component 203 (of FIG. 2) to be inserted up into the lined up through-holes 215 and 315 to extend into the vertical channel of the tee joint.

In other embodiments the constricted end 223 of leg component 203 fits up into leg holder 307 but does not extend up into the bottom through-holes of the two frame components 201 inserted into tee joint 302. Each guard pole 205 has a constricted guard connection end 225 that extends downward via through-hole 315 of the tee joint 302 and into the through-holes of the two frame components 201 inserted into tee joint 302. In some embodiments the constricted end 225 extends down through the bottom through-holes of the two frame components 201 down far enough so that the bolt hole of constricted end 225 lines up with the top bolt hole of the tee joint 302. This allows the bolt 208 to be fastened through the bolt hole of constricted end 225, thus securing guard pole 205 firmly in place. In some embodiments a nut 209 may be used to secure the bolt 208 firmly, but removably, in place. In other embodiments one or more of the components' bolt holes may be configured with internal threads into which the bolt 208 screws, to affix it firmly, but removably, in place. In yet other embodiments a nut 209 may be welded, glued or otherwise attached outside the bolt hole through which the bolt 208 passes to secure the bolt in place, thus removably securing the components together. The various embodiments that use nuts 209 to secure the parts together may also use washers and or lock washers with the nuts 209 to prevent them from loosening over time.

In various embodiments the diameter of the leg component 203 constricted end 223 is larger than the diameter of the guard pole 205 constricted end so that the guard pole 205 constricted end fits within the leg component 203 constricted end. Other embodiments are configured so that the leg component 203 constricted end is smaller and fits into the guard pole 205 constricted end. In yet other embodiments either the end of leg component 203 or guard pole 205 may be flaired out or otherwise enlarged, so as to fit on the outside of the tee joint 302. In the various embodiments end of guard pole 205, the end of leg component 203 and the leg holder section 307 of tee joint 302 are concentric. Being concentrically fit together, the guard pole 205 fits within the end of leg component 203 which itself fits within the round end (cross-section) of tee joint 302—that is, within the leg holder section 307. In some embodiments the frame component 201 has a flaired end that fits around the tee joint 202, or at least partially around (e.g., around three sides) of tee joint 202 allowing the leg holder section 307 portion to extend downward.

Figure 4A:
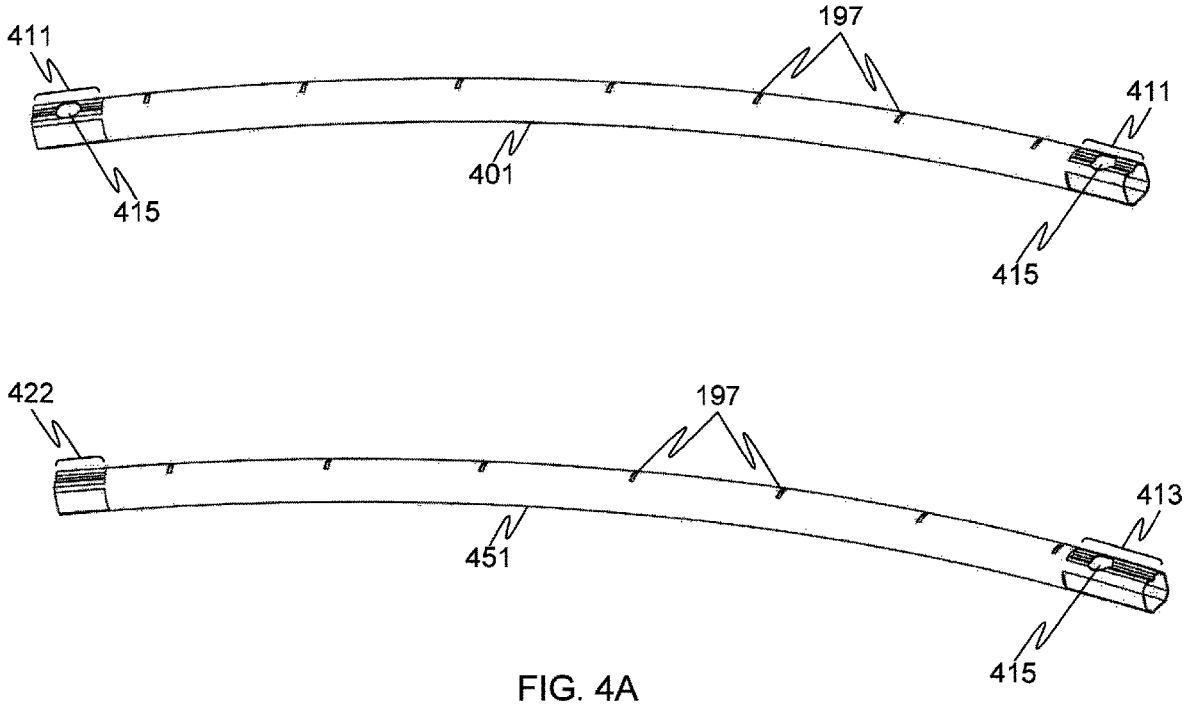
FIG. 4A depicts oblique views of two frame components according to various embodiments disclosed herein.

FIG. 4A depicts oblique views of two frame components 401 and 451 according to various embodiments disclosed herein. The frame component 401 has two symmetrical ends, each configured with through-hole 415 and a connection section 411. In various embodiments the connection sections may either he constricted or flaired out, so as to concentrically fit the adjacent piece or pieces in the trampoline frame. Slotted (or other shaped) holes 197 in the frame components 401 and 451 may serve as spring attachment structures. The frame component 401 can be used with tee joint 302 shown in FIG. 3. In such embodiments the connection sections 415 of adjacent frame components 401 are inserted into each side of the frame passageway 310 of tee joint 302. The connection sections 415 are configured to be slid in far enough until the adjacent frame components 401 concentrically fit together within the frame passageway 310 of tee joint 302 and the through-holes 415 align with through-hole 315 of tee joint 302. In some embodiments one end of frame component 401 may be configured larger than the outside dimensions of tee joint 302 so as to fit on the outside of it as the three parts—the tee joint 302 and two frame components 401–are concentrically fitted together.

The frame component 451 is configured with a through-hole 415 on connection section 413, and no through-hole on connection section 422. The frame component 451 can be used with tee joint 322 shown in FIG. 3. In various embodiments the connection section 413 end of frame component 451 with through-hole 415 is inserted into the short side of tee joint 322's frame passageway 310 far enough until the parts concentrically fit together and the through-hole 415 of frame component 451 aligns with through-hole 315 of tee joint 322. The end without a through-hole of adjacent frame component 451 may then be inserted into frame passageway 310 to concentrically fit together with tee joint 322. In some embodiments the two adjacent frame components 451 do not fit together concentrically. Instead, each of the adjacent frame components 451 fit within the frame passageway 310 of tee joint 322 with their ends facing each other (rather than having the adjacent frame components 451 fit concentrically). That is, each of the adjacent frame components 451 fit concentrically within (or on the outside of) the tee joint 322, but the adjacent frame components 451 do not themselves fit concentrically together. In other embodiments the connection section 413 is approximately the same length as frame passageway 310 of tee joint 322. In such embodiments the connection section 413 is inserted into the short side of tee joint 322's frame passageway 310 until the connection section 413 extends to the far end of the frame passageway 310 and the parts concentrically fit together. The connection section 422 of adjacent frame components 451 fits within (or outside of) the connection section 413 so the three parts concentrically fit together.

Figure 4B:
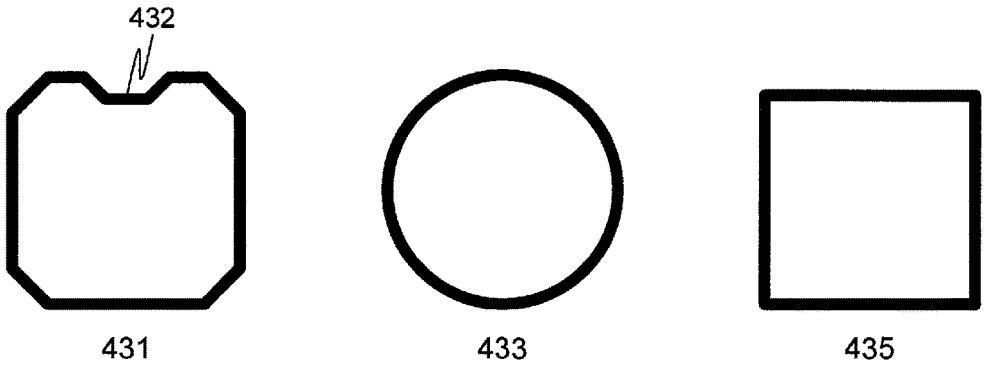
FIG. 4B depicts side views of three frame components embodiments.

FIG. 4B depicts side views of three frame components embodiments. The frame components 401 and 451 can be implemented with various cross-section shapes at their ends. Component end shapes 431, 433 and 435 are three typical embodiments. Component end shape 431 is basically a square cross-sectional shape with angled corners shaped like a square with chamfered corners. Component end shape 431 features a pressed groove 432 that extends the length of its connection section 413 (e.g., connection section 411). The frame components 401 and 451 can be implemented in a round such as end shape 433 or a square such as end shape 435. Frame components 401 and 451 can also be implemented in various other cross-sectional end shapes, including for example, rectangular, triangular, oval, octagonal, star shaped, or other like cross-sectional end shapes known to those of ordinary skill in the art. Any of the various shapes may have one or more grooves 432 extending fully or partially along the connection section.

Figure 5:
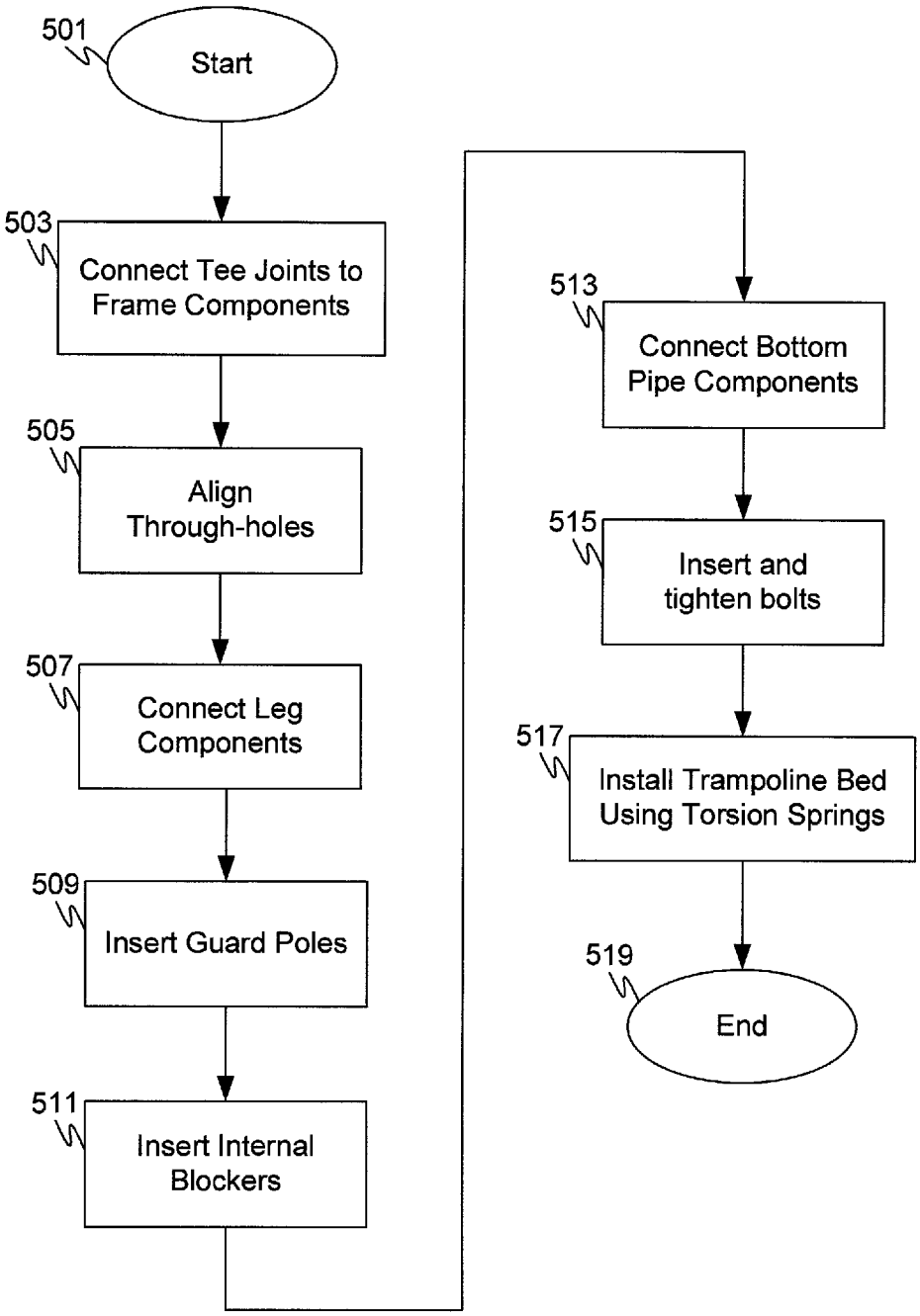
FIG. 5 is a flowchart of method steps according to various embodiments disclosed herein.

FIG. 5 is a flowchart of method steps according to various embodiments disclosed herein. The method starts at block 501 and proceeds to block 503 where the tee joints are connected to the frame components to form a frame shape that will hold the trampoline bed. In various embodiments the frame components (e.g., frame components 201 of FIG. 2) are inserted into the frame passageway of the tee joint (e.g., frame passageway 310 of tee joint 302) so that the parts concentrically fit together. Upon sliding the frame components into the tee joints the method proceeds to block 505.

In block 505 the insertion of the frame components is adjusted until their respective through-holes line up with the through-hole of the tee joint. Once the various through-holes are aligned the method proceeds from block 505 to block 507. The leg components are inserted into the leg holder section of their respective tee joints. Some embodiments use bolts to further strengthen the trampoline frame. In such embodiments the parts are slide together so that their bolt holes align, allowing insertion of a bolt to be secured firmly with a nut.

Upon inserting the leg components in block 507 the method proceeds to block 509 to insert the guard poles. The guard poles are attached to the top of the tee joint, passing through-holes of the tee joint and both frame components that are themselves attached to the tee joint. In some embodiments the guard poles are inserted far enough that they extend down into the leg components. In this way the guard pole, the two frame components and the tee joint are concentrically connected at each intersection. In some embodiments the leg component is concentrically fitted together with the tee joint and the guard pole, but the leg component isn't typically inserted far enough up into the joint to be concentrically connected to the frame components.

In block 511 the internal blockers are installed. Some embodiments do not have a guard pole affixed to each tee joint. For example, the embodiment depicted in FIG. 1 has a guard pole at every other tee joint, and internal blockers at the tee joints in between. Some internal blockers—for example, internal blocker 206 of FIG. 2—are merely caps put over the tee joint through-hole to prevent water and debris from getting inside the pipes. In other embodiments the internal blockers are shaped the same as the guard poles from the level of the tee joint through-hole downward. These embodiments of internal blockers are installed in much the same way as the guard poles, but do not extend upward above the level of the trampoline bed like the guard poles. They do, however, extend downward into the tee joint in order to be concentrically fitted with the tee joint, the two frame components—and in some embodiments, the leg component also.

Block 513 involves the installation of the bottom pipe components. In some embodiments the leg components sit directly on the ground. Other embodiments are implemented with a bottom pipe component attached to the leg components. The bottom pipe component sits on the ground and ties together two or more of the leg components, serving to further strengthen the structure. In such embodiments the bottom pipe components are affixed to the leg components in block 513. Upon completing block 513 the method proceeds to block 515 to insert and tighten the various bolts and nuts. For example, the embodiment depicted in FIG. 2 has two bolt holes in the leg holder section of tee joint 202. Both bolts extend through the tee joint 202 and through the leg component 203. The topmost bolt also extends through the bolt hole on guard connection end 225 of leg component 203 in the embodiment of FIG. 2.

Once all the bolts have been installed and tightened in block 517 the method proceeds to bock 517 for installation of the trampoline bed. Typically, trampoline beds are made of flexible, but durable, fabric such as a woven nylon fabric. Other embodiments have trampoline beds made of strips of nylon or other material (e.g., 1" to 2" wide strips) woven together to form a flexible fabric. However, the trampoline bed may be made of any number of flexible, sturdy materials such as cotton, rayon, or other fabrics man-made or natural fibers known to those of ordinary skill in the art. In block 517 the trampoline bed is installed by stretching springs between the spring attachment structures on the frame and the trampoline bed. The spring attachment structures may be slotted (or other shaped) holes in the frame components, or metal loops affixed (e.g., welded or glued) on the frame components, or eye bolts or hooks inserted through holes in the frame components, or other such mechanical attachment structures suitable for fastening a metal loop as known by those of ordinary skill in the art. The trampoline bed is typically put in place by installing two springs on opposite sides of the bed, then installing two more springs halfway around the bed between the first two spring, then going back and forth filling in the gaps until springs are installed all the way around. This avoids exposing any single spring to an excessive amount of force that would potentially damage the spring. Once all the springs have been installed the method proceeds to block 519 and ends.

Some of the method steps or activities may be included or excluded as described above, or performed in a different order than depicted in FIG. 5, while still remaining within the scope of at least one of the various embodiments. For example, the bottom pipe components (block 513) may be performed after installing the leg components (block 507). Further, blocks 509 and 511 may be reversed or performed at the same time. Numerous other steps and activities may be implemented in various different orders or performed at the same time, as is known by one of ordinary skill in the art.

The terminology used herein is for the purpose of describing particular embodiments only and is not intended to be limiting of the invention. For the purposes of description herein a trampoline is a type of sports equipment that has a flexible bed (e.g., fabric or woven mesh) connected by tension springs to a frame, allowing a user to jump or bounce up and down on it. As used in the specification and claims the term "substantially" means plus or minus (+/−) ten percent. For example, "substantially one inch" means "one inch plus or minus ten percent." As used herein, the singular forms "a", "an" and "the" are intended to include the plural forms as well, unless the context clearly indicates otherwise. It will be further understood that the terms "comprises," "comprising," "includes," and/or "including" used in this specification specify the presence of stated features, integers, steps, operations, elements, and/or components, but do not preclude the presence or addition of one or more other features, integers, steps, operations, elements, components, and/or groups thereof. The term "plurality", as used herein and in the claims, means two or more of a named element. It should not, however, be interpreted to necessarily refer to every instance of the named element in the entire device. Particularly, if there is a reference to "each" element of a "plurality" of elements. There may be additional elements in the entire device that are not be included in the "plurality" and are not, therefore, referred to by "each."

The descriptive text in this disclosure includes directional phrases and words such as up, down, above, beneath, below, on top of, or the like. Since the torsion springs of a trampoline are pulled down by the earth's gravity acting on the mass of a user, the directional phrases and words are relative to the earth. For example, down is the direction towards the center of the earth. The phrase "level of the trampoline bed", as this term is used herein, means the upper surface of the trampoline flexible fabric bed (or other bed material) in an undisturbed state; i.e., without a user on the trampoline. In embodiments where the frame components are assembled into a planar circle (typical) the level of the trampoline bed is a planar surface.

The phrase "concentrically fit together" (or "fits concentrically together") in regards to two components means that a portion of one of the components fits into an opening on the other component. For example, a bolt and a nut that screw together can be said to concentrically fit together. Turning to the specification, FIG. 2 depicts frame component 201 having a constricted first end 212 that fits within the frame passageway of tee joint 202. Thus, the frame component 201 concentrically fits together with tee joint 202. In some embodiments the frame components have flaired ends so as to fit around the tee joints 202. Such flaired out frame components are also said to concentrically fit together with the tee joints. Three or more objects can concentrically fit together—e.g., two objects concentrically fit together within a third object. For example, some car antennas used to be made of multiple telescoping sections that concentrically fit together. For two adjacent frame components that concentrically fit together within the frame passageway of the tee joint, the three parts are said to concentrically fit together.

The word "removably" as used with affix, attach, secure or the like word in regards to two or more parts, means that the two or more parts are affixed together (or attached, secured, etc.) firmly so they tend not to come apart by themselves, but may be release from each other without damaging the two parts. For example, a bolt and corresponding nut may be used to removably attach two parts. But two parts welded or glued together are generally not said to be removably attached to each other.

The corresponding structures, materials, acts, and equivalents of all means or step plus function elements, if any, in the claims below are intended to include any structure, material, or act for performing the function in combination with other claimed elements as specifically claimed. The disclosure of the various embodiments has been presented for purposes of illustration and description, and is not intended to be exhaustive in the form disclosed. Many modifications and variations will be apparent to those of ordinary skill in the art without departing from the scope and gist of the invention. The various embodiments included herein were chosen and described in order to best explain the principles of the invention and the practical application, and to enable others of ordinary skill in the art to understand the invention for various embodiments with various modifications as are suited to the particular use contemplated. The description of the various embodiments provided above is illustrative in nature inasmuch as it is not intended to limit the invention, its application, or uses. Thus, variations that do not depart from the intents or purposes of the invention are encompassed by the various embodiments of the present invention. Such variations are not to be regarded as a departure from the intended scope of the present invention.

What is claimed:

1. A trampoline frame comprising:

a plurality of tee joints including a first tee joint and a second tee joint, the first tee joint comprising a first frame passageway extending through the first tee joint, the first tee joint further comprising a first tee through-hole;

a plurality of leg components includes a first leg component and a second leg component:

a plurality of frame components including a first frame component and a second frame component;

the first frame component comprising a first end, a second end and a first frame through-hole, wherein the first end is configured to fit within the first frame passageway far enough to align the first frame through-hole with the first tee through-hole;

the second frame component comprising a third end and a second frame through-hole, wherein the third end is configured to fit within the first frame passageway far enough to concentrically fit with the first frame component and align the second frame through-hole with the first tee through-hole;

a plurality of guard poles including a first guard pole and a second guard pole:

the first guard pole configured to fit through the first tee through-hole, the first frame through-hole and the second frame through-hole and concentrically fit together with the first leg component;

a top end of the first leg component configured to fit up into the first tee joint; the top end of the first leg component further being configured to receive a bottom end of the first guard pole; and a bolt configured to extend through bolt holes in the first tee joint and the first leg component.

2. The trampoline frame of claim 1, wherein the first tee joint comprises a first leg holder section, the trampoline frame further comprising:

the first leg component configured to concentrically fit together with the first leg holder section of the first tee joint.

3. The trampoline frame of claim 2, further comprising:

a plurality of internal blockers comprising a first internal blocker and a second internal blocker;

the first internal blocker is configured to extend through a second tee through-hole in the second tee joint and concentrically fit together with the second leg component in a second leg holder section of the second tee joint.

4. The trampoline frame of claim 1, further comprising:

a bottom pipe component that removably affixes to the first leg component and the second leg component.

5. The trampoline frame of claim 1, wherein the first frame component has a third frame through-hole, the trampoline frame further comprising:

the second tee joint comprising a second tee through-hole, a second leg holder section and a second frame passageway extending through the second tee joint;

the second leg component configured to concentrically fit together with the second leg holder section. of the second tee joint;

wherein the second end of the first frame component is configured to fit within the second frame passageway far enough to align the third frame through-hole with the second tee through-hole.

6. The trampoline frame of claim 3, wherein the first internal blocker and the second internal blocker do not extend upward substantially above a level of a trampoline bed suspended from the plurality of frame components.

7. A trampoline frame comprising:

a plurality of tee joints including a first tee joint and a second tee joint, the firs tee joint comprising a first tee through-hole and a first leg holder section:

a plurality of leg components including a first leg component and a second ter component a plurality of frame components including a first frame component and a second frame component the first frame component comprising a first end, a second end and a first frame through-hole, wherein the first end is configured to concentrically fit with the first tee joint to align the first frame through-hole with the first tee through-hole;

the second frame component comprising a third end and a second frame through-hole, wherein the third end is configured to concentrically fit with the first tee joint and the first frame component and align the second frame through-hole with the first tee through-hole:

a plurality of internal blockers comprising a first internal blocker and a second internal blocker:

the first internal blocker comprising a bottom end configured to fit through the first tee through-hole, the first frame through-hole and the second frame through-hole;

a top end of the first leg component configured to fit up into the first leg holder section of the first tee joint, the top end of the first leg component further being configured to receive the bottom end of the first internal blocker; and a bolt configured extend through bolt holes in the first tee joint and the first leg component.

8. The trampoline frame of claim 7, further comprising:

a bottom pipe component that removably affixes to the first leg component and the second leg component.

9. The trampoline frame of claim 7, wherein the first frame component has a third frame through-hole, the trampoline frame further comprising:

the second tee joint comprising a second tee through-hole and a second leg holder section;

the second leg component configured to concentrically fit together with the second leg holder section of the second tee joint;

wherein the second end of the first frame component concentrically fits with the second tee joint to align the third frame through-hole with the second tee through-hole.

10. The trampoline frame of claim 9, further comprising:

a top end of the second leg component configured to concentrically fit within the second leg holder sector of the second tee joint, the top end of the second leg component further being configured to receive either a first guard pole or the second internal blocker.

11. The trampoline frame of claim 10, further comprising:

a plurality of guard poles including the first guard pole and a second guard pole:

the first guard pole is configured to extend through both the second tee through-hole and the third frame through-hole to concentrically fit in the top end of the second leg component, within the second leg, holder section of the second tee joint.

12. The trampoline frame of claim 1, wherein the first internal blocker and the second internal blocker do not extend upward substantially above a level of a trampoline bed suspended from the plurality of frame, components.

13. A method of assembling a trampoline frame, comprising:

providing a first tee joint comprising a first frame passageway extending through the first tee joint and further comprising a first tee through-hole, wherein the first tee joint comprises a first leg, holder section:

providing a first frame component comprising a first end, a second end and a first frame through-hole, and further providing a second frame component comprising a third end and a second frame through-hole;

inserting the first end of the first frame component and the third end of the second frame component into opposite ends of the first frame passageway far enough to concentrically fit together within the first frame passageway;

aligning the first frame through-hole and the second frame through-hole with the first tee through-hole;

inserting an internal blocker through the first tee through hole, the first frame through-hole and the second frame through-hole;

attaching a first leg component to the internal blocker within a first leg holder section of the first tee joint, the first leg component concentrically fitting together with the internal blocker; and inserting a bolt through bolt holes in the first tee joint and the first leg component.

14. The method of claim 13, further comprising:

inserting the internal blocker through the first tee through-hole far enough concentrically fit together with the first leg holder section of the first tee joint.

15. The method of claim 13, further comprising:

removably affixing a bottom pipe component to the first leg component and the second leg component.

16. The method of claim 13, wherein the first frame component has a third frame through-hole, the method further comprising:

providing a second tee joint comprising a second tee through-hole, a second leg holder section and a second flame passageway extending through the second tee joint;

concentrically fitting the second leg component together with a guard pole in the second leg holder sectionthe second tee joint;

wherein the second end of the fiat frame component is configured to fit within the second frame passageway far enough to align the third frame through-hole with the second tee through-hole.

17. The method of claim 13, wherein the internal blocker does not extend upward substantially above a level of a trampoline bed suspended from the first and second frame components.

* * * * *